US009719453B2

(12) United States Patent
Beer et al.

(10) Patent No.: US 9,719,453 B2
(45) Date of Patent: Aug. 1, 2017

(54) ELECTRIC ACTUATION OF A VALVE BASED ON KNOWLEDGE OF THE CLOSING POINT AND OPENING POINT OF THE VALVE

(71) Applicant: Continental Automotive GmbH, Hannover (DE)

(72) Inventors: Johannes Beer, Regensburg (DE); Alexander Artinger, Reichenbach (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 279 days.

(21) Appl. No.: 14/427,441

(22) PCT Filed: Sep. 23, 2013

(86) PCT No.: PCT/EP2013/069670

§ 371 (c)(1),
(2) Date: Mar. 11, 2015

(87) PCT Pub. No.: WO2014/044837

PCT Pub. Date: Mar. 27, 2014

(65) Prior Publication Data

US 2015/0226148 A1 Aug. 13, 2015

(30) Foreign Application Priority Data

Sep. 24, 2012 (DE) ..... 10 2012 217 121

(51) Int. Cl.
*F02M 51/00* (2006.01)
*F02D 41/30* (2006.01)
(Continued)

(52) U.S. Cl.
CPC ..... *F02D 41/3005* (2013.01); *F02D 41/247* (2013.01); *F02M 51/005* (2013.01);
(Continued)

(58) Field of Classification Search
CPC .. F02D 41/3005; F02D 41/247; F02D 41/401; F02D 41/2464; F02D 41/2467;
(Continued)

(56) References Cited

U.S. PATENT DOCUMENTS 4,092,717 A 5/1978 Di Nunzio ..... 701/115
4,102,181 A 7/1978 Cser et al. ..... 73/114.49
(Continued)

FOREIGN PATENT DOCUMENTS

CN 101903629 A 12/2010 ..... F02D 41/20
DE 2658253 A1 7/1977 ..... F02M 65/00
(Continued)

OTHER PUBLICATIONS

Chinese Office Action, Application No. 201380049632.0, 13 pages, Jul. 20, 2016.

(Continued)

*Primary Examiner* — Hai Huynh
(74) *Attorney, Agent, or Firm* — Slayden Grubert Beard PLLC

(57) ABSTRACT

A method for determining an effective injection time of a valve having a coil drive includes determining an opening time of the valve, determining a closing time of the valve, and determining the effective injection time of the electric actuation of the valve for an injection operation based on the defined opening time and the defined closing time.

12 Claims, 6 Drawing Sheets

(51) Int. Cl.

| | |
|---|---|
| ***F02D 41/24*** | (2006.01) |
| ***F02M 51/06*** | (2006.01) |
| ***F02M 65/00*** | (2006.01) |
| *F02D 41/20* | (2006.01) |

(52) U.S. Cl.
CPC ..... *F02M 51/061* (2013.01); *F02M 65/00* (2013.01); *F02D 2041/2055* (2013.01); *F02D 2041/2058* (2013.01)

(58) Field of Classification Search
CPC ..... F02D 2041/2055; F02D 2041/2058; F02D 2041/2062; F02M 65/00; F02M 65/005; F02M 51/005; F02M 51/061
USPC ..... 123/490; 701/105; 73/114.45, 114.49
See application file for complete search history.

(56) References Cited

U.S. PATENT DOCUMENTS

| | | | | |
|---|---|---|---|---|
| 5,747,684 | A * | 5/1998 | Pace | F02M 65/00 73/114.49 |
| 7,945,372 | B2 | 5/2011 | Geveci et al. | 701/103 |
| 8,884,609 | B2 | 11/2014 | Bolz | 324/207.16 |
| 8,887,560 | B2 | 11/2014 | Beer et al. | 73/114.49 |
| 8,935,114 | B2 | 1/2015 | Beer et al. | 702/65 |
| 2012/0158271 | A1 * | 6/2012 | Joos | F02D 41/2467 701/104 |
| 2012/0239278 | A1 | 9/2012 | Becker et al. | 701/105 |
| 2013/0104636 | A1 | 5/2013 | Beer et al. | 73/114.49 |
| 2014/0012485 | A1 | 1/2014 | Brandt et al. | 701/103 |
| 2014/0092516 | A1 | 4/2014 | Koch et al. | 361/160 |

FOREIGN PATENT DOCUMENTS

| | | | | |
|---|---|---|---|---|
| DE | 2651355 | C3 | 9/1981 | F02D 41/20 |
| DE | 257662 | A1 | 6/1988 | F02D 41/20 |
| DE | 102009032521 | A1 | 1/2011 | F02D 41/20 |
| DE | 102009029590 | A1 | 3/2011 | F02D 41/20 |
| DE | 102010018290 | A1 | 10/2011 | F02D 41/20 |
| DE | 102010019013 | A1 | 11/2011 | F02D 41/20 |
| DE | 102010042467 | A1 | 4/2012 | F02D 41/20 |
| DE | 102010042852 | A1 | 4/2012 | F02D 41/14 |
| DE | 102011005672 | A1 | 9/2012 | F02D 41/20 |
| GB | 2450523 | A | 12/2008 | F02D 41/20 |
| WO | 2011/134794 | A1 | 11/2011 | F02D 41/20 |
| WO | 2014/044837 | A1 | 3/2014 | F02D 41/24 |

OTHER PUBLICATIONS

International Search Report and Written Opinion, Application No. PCT/EP2013/069670, 17 pages, Dec. 3, 2013.

* cited by examiner

ELECTRIC ACTUATION OF A VALVE BASED ON KNOWLEDGE OF THE CLOSING POINT AND OPENING POINT OF THE VALVE

CROSS-REFERENCE TO RELATED APPLICATIONS

This application is a U.S. National Stage Application of International Application No. PCT/EP2013/069670 filed Sep. 23, 2013, which designates the United States of America, and claims priority to DE Application No. 10 2012 217 121.5 filed Sep. 24, 2012, the contents of which are hereby incorporated by reference in their entirety.

TECHNICAL FIELD

The present invention relates to the technical field of actuating coil drives for a valve, in particular for a direct injection valve for an internal combustion engine of a motor vehicle. The present invention relates, in particular, to a method for acquiring an injection time when operating a valve with improved quantity accuracy. The present invention also relates to a corresponding device and to a computer program for carrying out the specified method.

BACKGROUND

In order to operate modern internal combustion engines and to comply with strict limiting values for emissions, an engine controller determines, by means of what is referred to as the cylinder filling model, the mass of air enclosed in a cylinder per working cycle. In accordance with the modeled air mass and the desired ratio between the air quantity and fuel quantity (Lambda) the corresponding fuel quantity setpoint value (MFF_SP) is injected by means of an injection valve, which is also referred to as an injector in this document. The fuel quantity to be injected can therefore be dimensioned in such a way that an optimum value for lambda is present for the exhaust gas post-treatment in the catalytic converter. For direct-injection spark-ignition engines with internal mixture formation, the fuel is injected directly into the combustion chamber at a pressure in the range from 40 to 200 bar.

A main requirement made of the injection valve is, along with leaktightness to prevent uncontrolled outflow of fuel and preparation of the jet of the fuel to be injected, also precise measurement of a predefined setpoint injection quantity. In particular in the case of super-charged direct-injection spark-ignition engines, a very large quantity spread of the required fuel quantity is necessary. Therefore, a maximum fuel quantity MFF_max per working cycle has to be metered for the super-charged mode at the full load of the engine, for example, whereas during operation near to idling conditions a minimum fuel quantity MFF_min has to be metered. The two characteristic variables MFF_max and MFF_min define here the limits of the linear working range of the injection valve. This means that for these injection quantities there is a linear relationship between the electric actuation duration (Ti) and the injected fuel quantity per working cycle (MFF).

The quantity spread, which in the case of a constant fuel pressure is defined as the quotient between the maximum fuel quantity MFF_max and the minimum fuel quantity MFF_min, for direct injection valves with a coil drive is approximately 15. For future engines in which the emphasis is on carbon dioxide reduction, the cubic capacity of the engines is reduced and the rated power of the engine is maintained or even raised by means of corresponding engine super-charging mechanisms. The required maximum fuel quantity MFF_max therefore corresponds at least to the requirements made of an induction engine with a relatively large cubic capacity. However, the minimum fuel quantity MFF_min is determined by means of operation close to idling conditions and the minimum air mass in the overrun mode of the engine with a decreased cubic capacity, and is therefore reduced. In addition, direct injection permits distribution of the entire fuel mass over a plurality of pulses, which permits more stringent limiting values for emissions to be complied with, for example in a catalytic converter heating mode by virtue of what is referred to as mixture stratification and a later ignition time. For the reasons mentioned above, future engines will be subject to increased requirements both in terms of the quantity spread and the minimum fuel quantity MFF_min.

In the case of known injection systems, a significant deviation of the injection quantity from the nominal injection quantity occurs at injection quantities which are less than MFF_min. This systematically occurring deviation can be attributed essentially to fabrication tolerances at the injector as well as to tolerances of the output stage, which actuates the injector, in the engine controller, and therefore to deviations from the nominal actuation current profile.

The electric actuation of a direct injection valve is typically carried out by means of a current-regulated full-bridge output stage. Under the peripheral conditions of application in a vehicle, only limited accuracy of the current profile with which the injector is supplied can be achieved. The resulting variation in the actuation current and the tolerances at the injector have significant effects on the achievable accuracy of the injection quantity, in particular in the range of MFF_min and below.

The characteristic curve of an injection valve defines the relationship between the injected fuel quantity MFF and the time period or the injection time Ti of the electric actuation as well as of the fuel pressure FUP (MFF=f(Ti,FUP)). The inversion of this relationship $Ti=f^{-1}$ (MFF_SP,FUP) is used in the engine controller to convert the setpoint fuel quantity (MFF_SP) into the necessary injection time. The additional influencing variables, such as for example the cylinder internal pressure ($P_{cyl}$) during the injection process, fuel temperature ($\Theta_{fuel}$) and possible variations of the supply voltage, which are input into this calculation, are omitted here for the sake of simplification.

FIG. 1 shows the characteristic curve of a direct injection valve. Here, the injected fuel quantity MFF is plotted as a function of the time period Ti of the electric actuation. As is apparent from FIG. 1, a working range which is linear to a very good approximation is obtained for the time periods Ti which are longer than Ti_min. This means that the injected fuel quantity MFF is directly proportional to the time period Ti of the electric actuation. A highly non-linear behavior occurs for time periods Ti which are shorter than Ti_min. In the illustrated example, Ti_min is approximately 0.5 ms.

The gradient of the characteristic curve in the linear working range corresponds to the static flow through the injection valve, i.e. the fuel throughflow rate which is achieved continuously in the case of a complete valve stroke. The cause of the non-linear behavior for time periods or injection times Ti which are shorter than approximately 0.5 ms or of fuel quantities MFF<MFF_min is, in particular, the inertia of an injector spring mass system and the chronological behavior during the building up and reduction of the magnetic field through a coil, which magnetic field activates the valve needle of the injection valve. As a result of these dynamic effects, the complete valve stroke is no longer achieved in what is referred to as the ballistic range. This means that the valve is closed again before the structurally predefined end position, which defines the maximum valve stroke, has been reached.

In order to ensure a defined and reproducible injection quantity, direct injection valves are usually operated in their linear working range. At present, operation in the non-linear range is not carried out since, owing to the abovementioned tolerances in the current profile and mechanical tolerances of injection valves (for example pretensioning force of the closing spring, stroke of the valve needle, internal friction in the armature/needle system), a significant systematic error occurs in the injection quantity. It becomes apparent from this that for reliable operation of an injection valve there must be a minimum fuel quantity MFF_min per injection pulse, which quantity has to be at least provided in order to be able to implement the desired injection quantity in a precisely quantified way. In the example illustrated in FIG. 1, this minimum fuel quantity MFF_min is somewhat smaller than 5 mg.

The electric actuation of a direct injection valve is usually carried out by means of current-regulated full-bridge output stages of the engine controller. A full-bridge output stage permits the injection valve to be supplied with an on-board power system voltage of the motor vehicle and alternatively with a boost voltage. The boost voltage (U_boost) can be, for example, approximately 60 V to 65 V. The boost voltage is usually made available by a DC/DC transformer.

FIG. 2 shows a typical current actuation profile I (thick continuous line) for a direct injection valve with a coil drive. FIG. 2 also shows the corresponding voltage U (thin continuous line) which is applied to the direct injection valve. The actuation is divided up into the following phases:

A) Pre-Charge Phase:

During this phase with the duration t_pch, the battery voltage U_bat, which corresponds to the on-board system voltage of the motor vehicle, is applied to the coil drive of the injection valve by the bridge circuit of the output stage. When a current setpoint valve I_pch is reached, the battery voltage U_bat is switched off by a two-level controller, and U_bat is switched on again after a further current threshold is undershot.

B) Boost Phase:

The pre-charge phase is followed by the boost phase. For this purpose, the boost voltage U_boost is applied by the output stage to the coil drive until a maximum current I_peak is reached. The opening of the injection valve is accelerated as a result of the rapid buildup of current. After I_peak is reached, a free-wheeling phase follows up to the expiry of t_1, and during this free-wheeling phase the battery voltage U_bat is again applied to the coil drive. The time period Ti of the electric actuation is measured starting from the beginning of the boost phase. This means that the transition into the free-wheeling phase as a result of the predefined maximum current I_peak being reached is triggered. The duration t_1 of the boost phase is permanently predefined as a function of the fuel pressure.

C) Commutation Phase:

After the expiry of t_1 there is a following commutation phase. As a result of switching off of the voltage, a self-induction voltage is produced here, which self-induction voltage is limited essentially to the boost voltage U_boost.

The commutation phase ends after the expiry of a further time period t_2.

D) Holding Phase:

The commutation phase is followed by what is referred to as the holding phase. Here, the setpoint value for the setpoint holding current I_hold is regulated by means of the battery voltage U_bat, again by means of a two-level controller.

E) Switch-Off Phase:

As a result of switching off of the voltage a self-induction voltage is produced, which self-induction voltage is, as explained above, limited to the recuperation voltage. As a result a current flow is produced through the coil, which current flow now reduces the magnetic field. After the recuperation voltage, which is shown to be a negative value here, has been exceeded, current no longer flows. This state is also referred to as "open coil". Owing to the ohmic resistances of the magnetic material, the eddy currents which are induced during the field reduction of the coil decay. The reduction in the eddy currents leads in turn to a change in the field in the magnetic coil and therefore to a voltage induction. This induction effect causes the voltage value at the injector to rise to the value "zero" starting from the level of the recuperation voltage in accordance with the profile of an exponential function. The injector closes after the reduction of the magnetic force by means of the spring force and the hydraulic force which is caused by the fuel pressure.

The described actuation of an injection valve has the disadvantage that the times, subject to tolerances, of both the opening and closing of the injection valve or of the injector in the "open coil" phase have a negative effect on the quantity accuracy of the injected fuel.

SUMMARY

One embodiment provides a method for determining an effective injection time of a valve which has a coil drive, wherein the method comprises the following steps: determining an opening time of the valve; determining a closing time of the valve; acquiring the effective injection time (Ti_eff_sp) of the electric actuation of the valve for an injection process taking into account the determined opening time and the determined closing time, the injection time ($Ti_N$) is acquired by means of an iterative procedure for a sequence of different injection pulses, in which procedure a correction value ($f_{adaptation}(\cdot)_N$) for the injection time of the electric actuation of the valve is determined for a future injection process as a function of (a) a correction value for the injection time of the electric actuation of the valve for a preceding injection process, and (b) a time difference ($\Delta Ti_N$) between (b1) a nominal effective injection time ($Ti_eff_sp_N$) for the electric actuation of the valve, and (b2) an individual effective injection time ($Ti_eff_N$) for the electric actuation of the valve for the preceding injection process, wherein the individual effective injection time ($Ti_eff_N$) is obtained from the time difference between the start of the electric actuation of the valve for the preceding injection process and the determined closing time for the preceding injection process.

In a further embodiment, the effective injection time is acquired using the formula $$Ti_eff = Ti + (Topen - Topen_nom) + Tclose,$$

where Topen is the determined opening time, Tclose is the determined closing time, Topen nom is a nominal opening time for a valve and Ti is a calculated nominal injection time.

In a further embodiment, the determination of the opening time comprises determining a current profile at an element of the valve, in particular a solenoid of a solenoid valve, and determining the opening time taking into account the determined current profile.

In a further embodiment, the determination of the closing time comprises switching off of a current flow through a coil of the coil drive, with the result that the coil is currentless, detecting a time profile of a voltage induced in the currentless coil, and determining the closing time of the valve on the basis of the detected time profile.

In a further embodiment, the determination of the closing time comprises comparing (a) a time derivative of the detected time profile of the voltage induced in the coil with (b) a time derivative of the reference voltage profile.

In a further embodiment, the time difference ($\Delta Ti_N$) between the nominal effective injection time (Ti_eff_sp) and the individual effective injection time ($Ti_N$) is weighted with a weighting factor c.

In a further embodiment, the method further comprises actuating the valve on the basis of the acquired injection time ($Ti_N$).

Another embodiment provides a device, e.g., an engine controller, for acquiring an effective injection time of a valve having a coil drive, wherein the device includes: a unit for determining an opening time of the valve; a unit for determining a closing time (Tclose) of the valve; a unit for acquiring the effective injection time ($Ti_eff_N$) of the electric actuation of the valve for an injection process on the basis of the determined opening time and the determined closing time, the injection time ($Ti_N$) is acquired by means of an iterative procedure for a sequence of different injection pulses, in which procedure a correction value ($f_{adaptation}(\cdot)_N$) for the injection time of the electric actuation of the valve is determined for a future injection process as a function of (a) a correction value for the injection time of the electric actuation of the valve for a preceding injection process, and (b) a time difference ($\Delta Ti_N$) between (b1) a nominal effective injection time ($Ti_eff_sp_N$) for the electric actuation of the valve, and (b2) an individual effective injection time ($Ti_eff_N$) for the electric actuation of the valve for the preceding injection process, wherein the individual effective injection time ($Ti_eff_N$) is obtained from the time difference between the start of the electric actuation of the valve for the preceding injection process and the determined closing time for the preceding injection process.

Another embodiment provides a computer program for acquiring an injection time ($Ti_N$) for electric actuation of a valve which has a coil drive, in particular a direct injection valve for an internal combustion engine, wherein the computer program, when executed by a processor, is configured to control the method disclosed above.

BRIEF DESCRIPTION OF THE DRAWINGS

Further advantages and features of the present invention can be found in the following exemplary description of currently preferred embodiments. The individual figures of the drawing of this application are to be considered to be merely schematic and not true to scale.

In the drawing.

DETAILED DESCRIPTION

Figure 1:
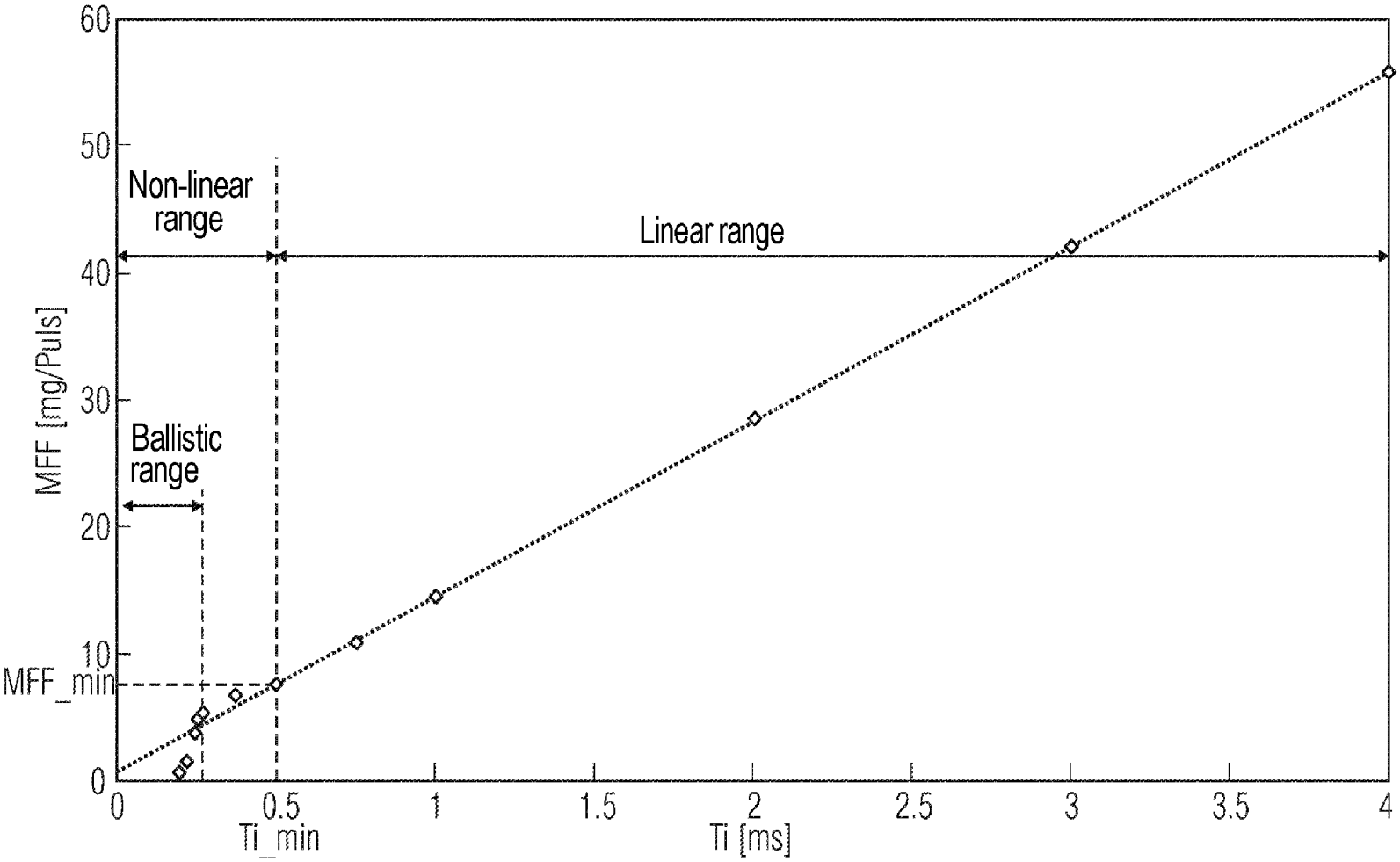
FIG 1 (Prior art)
FIG. 1 shows the characteristic curve of a known direct injection valve, illustrated in a diagram in which the injected fuel quantity MFF is plotted as a function of the injection time Ti of the electric actuation.
Figure 2:
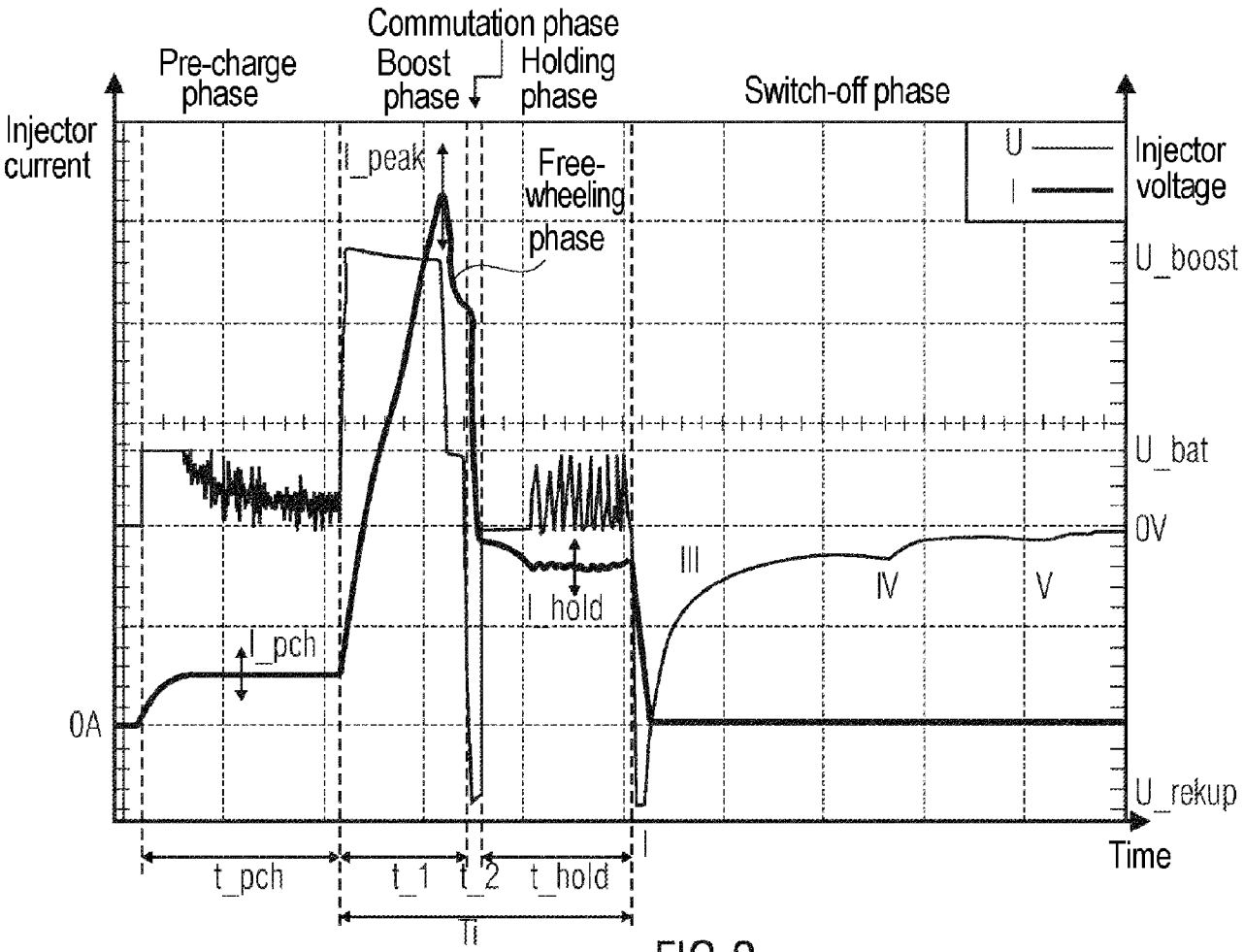
FIG 2 (Prior art)
FIG. 2 shows a typical current actuation profile and the corresponding voltage profile for a direct injection valve with a coil drive.

The invention is based on the object of improving the actuation of an injection valve to the effect that, in particular in the case of small injection quantities, for example in the case of injection quantities which are less than MFF_min, greater quantity accuracy can be achieved.

According to a first aspect, a method for determining an effective injection time of a valve which has a coil drive is provided, wherein the method comprises the following steps: determining an opening time (Topen) of the valve, determining a closing time (Tclose) of the valve and acquiring the effective injection time ($Ti_N$) of the electric actuation of the valve for an injection process taking into account the determined opening time and the determined closing time.

In particular, the acquired effective injection time can be calculated for a future injection process. For example, the determination of the opening time and of the closing time can be carried out by direct measurement or by measuring and evaluating a suitable variable. In particular, the measured variable can be an electric variable, for example current or voltage, which is determined by electric measurement. The measured variable can then be evaluated or analyzed in order to determine the opening time and/or the closing time.

For example, the term opening time of a valve can signify a time period or injection time which is given by a starting time and an end time. The time which is given by applying a voltage, for example the boost voltage, can preferably be used as the starting time. Alternatively, the starting time could also be given by the start of an opening movement. The end time is preferably given by the end of the opening movement, for example as a result of impacting of the valve needle against a stop, or in the case of a ballistic opening movement as a result of a reversal of the direction of movement, i.e. a start of a closing movement.

According to a further exemplary aspect, a device, in particular an engine controller, for acquiring an effective injection time of a valve having a coil drive is provided, wherein the device has: a unit for determining an opening time of the valve, a unit for determining a closing time (Tclose) of the valve and a unit for acquiring the effective injection time ($Ti_N$) of the electric actuation of the valve for an injection process on the basis of the determined opening time and the determined closing time.

According to a further aspect, a computer program is described for acquiring a time period or injection time for electric actuation of a valve which has a coil drive, in particular a direct injection valve for an internal combustion engine. The computer program is, when it is executed by a processor, configured to control the abovementioned method.

According to this document, the specification of such a computer program is equivalent to the term of a program element, a computer program product and/or a computer-readable medium which contains instructions for controlling a computer system in order to coordinate the method of operation of a system or of a method in a suitable way, in order to achieve the effects associated with the method according to the invention.

The computer program can be implemented as computer-readable instruction code in any suitable programming language such as, for example, in JAVA, C++ etc. The computer program can be stored on a computer-readable storage medium (CD-Rom, DVD, Blu-ray disk, a removable drive, volatile or non-volatile memory, installed memory/processor etc.). The instruction code can program a computer or other programmable devices such as, in particular, a control device for an engine of a motor vehicle in such a way that the desired functions are executed. In addition, the computer program can be made available in a network such as, for example, the Internet, from which it can be downloaded by a user if necessary.

The invention can be implemented by means of a computer program, i.e. by means of software, as well as by means of one or more special electric circuits, i.e. using hardware or in any desired hybrid form, i.e. by means of software components and hardware components.

A basic idea of an exemplary aspect may be, for the sake of acquiring injection times or actuation times as accurately as possible, to take into account not only the closing times but also the opening times of injectors of a valve. As a result, it may be possible to detect deviations of actually injected fuel quantities from the nominal quantity defined by means of the setpoint MFF_SP and to adapt the electric actuation duration of an injection valve by means of a correction value which depends on the injector opening time and injector closing time detected individually by the valve, in such a way that the deviation from the nominal fuel quantity is possibly minimized. By means of this method, the accuracy of the injection quantity can be significantly improved, possibly in particular for injection quantities which are smaller than MFF_min.

In particular, by means of a method according to an exemplary aspect, a variation in the opening behavior and closing behavior of the injector of a valve can be taken into account and possibly at least partially compensated or corrected. For example, variations in the injection quantity of the fuel which occur as a result of tolerances in the components of the valve can be reduced.

In the text which follows, developments of the method for acquiring an effective injection time are described. The embodiments apply however also to the device and to the computer program.

According to an exemplary embodiment of the method, the effective injection time is acquired by means of the formula Ti_eff=Ti+(Topen−Topen_nom)+Tclose, where Topen is the determined opening time, Tclose is the determining closing time, Topen nom is a nominal opening time for a valve, and Ti is the calculated nominal electric actuation duration.

Ti is here, in particular, the electric actuation duration which is a function of the setpoint fuel mass (MFF_SP), of the fuel pressure (FUP), of the pressure in a cylinder $P_{cyl}$ which has the corresponding valve, and of the temperature of the injected fuel ($\Theta_{fuel}$). In the form of a functional notation, Ti can thus be written as $Ti=f(MFF_SP,FUP,P_{cyl},\Theta_{fuel})$.

Topen_nom can preferably be determined in advance from measurements, for example by means of a nominal injector, and then stored in a characteristic diagram or table in a memory of an engine controller. Alternatively or additionally, the electric actuation duration Ti can also be determined previously, for example by means of a calculation or a measurement, and then stored in a memory of the engine controller, for example by means of a characteristic diagram.

According to one exemplary embodiment of the method, the determination of the opening time comprises the following steps: determining a current profile at an element of the valve, in particular a solenoid of a solenoid valve, and determining the opening time taking into account the determined current profile.

In particular, in order to determine the current profile at an element a characteristic or modified actuation profile can be used. The term "modified actuation profile" in this context can mean, in particular, that the actuation profile has been specifically changed compared to the actuation profile such as is used during normal operation of the engine controller. Such a modified actuation profile or current profile can be modified, in particular, to the effect that in order to determine the opening time of an injector needle of the valve, switching over is carried out to an actuation profile with a reduced chronological duration of the boost phase. The actuation profile with a reduced boost phase can be modified, in particular, in such a way that a maximum current during the boost phase is defined in such a way that a) the current at the measuring time does not exceed a maximum value, in particular is set in such a way that a signal/noise ratio can be selected, and that b) the maximum current during the boost phase is as high as possible in order to keep a method tolerance for implementation of the injection quantity small. A corresponding method can be found, for example, in the unpublished patent application DE 10 2011 005 672.

According to one exemplary embodiment of the method, the determination of the closing time comprises the following steps: switching off of a current flow through a coil of the coil drive, with the result that the coil is currentless, detecting a time profile of a voltage induced in the currentless coil, and determining the closing time of the valve on the basis of the detected time profile.

In particular, the determination of the closing time can comprise calculation of the time derivative of the detected time profile of the voltage which is induced in the currentless coil. For example, the determination of the closing time can comprise a comparison of the detected time profile of the voltage induced in the coil with a reference voltage profile.

In particular, in the case of the method the reference voltage profile can be acquired in that during the securing of a magnet armature of the coil drive in the closed position of the valve the voltage which is induced in the currentless coil is detected after the valve has been actuated electrically as in actual operation.

According to one exemplary embodiment of the method, the determination of the closing time comprises comparison (a) of a time derivative of the detected time profile of the voltage induced in the coil with (b) a time derivative of the reference voltage profile.

According to one exemplary embodiment of the method, the injection time ($Ti_N$) is acquired by means of an iterative procedure for a sequence of different injection pulses, in which procedure a correction value ($f_{adaptation}(MFF_SP,FUP,P_{cyl},\Theta_{fuel})_N$) for the injection time of the electric actuation of the valve is determined for a future injection process as a function of (a) a correction value for the injection time of the electric actuation of the valve for a preceding injection process, and (b) a time difference ($\Delta Ti_N$) between (b1) a nominal effective injection time ($Ti_eff_sp_N$) for the electric actuation of the valve and (b2) an individual effective injection time ($Ti_eff_N$) for the electric actuation of the valve for the preceding injection process, wherein the individual effective injection time ($Ti_eff_N$) is obtained from the time difference between the start of the electric actuation of the valve for the preceding injection process and the determined closing time for the preceding injection process.

In particular, the individual effective injection time can be estimated and calculated according to the formula Ti_eff=Ti+(Topen−Topen_nom)+Tclose, where Topen is the determined opening time, Tclose is the determined closing time, Topen nom is a nominal opening time for a valve and Ti is the calculated nominal electric actuation duration.

The term "nominal effective injection time" is to be understood here as a time period or injection time which is characteristic of the type of injection valve used and which occurs when no tolerances occur at the injector and output stage. For this reason, the nominal effective time period can also be understood to be the effective injection time of an injection valve which is of the same design and which is not subject to tolerances and which effective injection time is obtained from the time period of the electric actuation of an injection valve of the same design and the closing time Tclose. In this context, the closing time Tclose is defined by the time difference between the switching off of the actuation current and the determined closing of the valve or of the valve needle of the injection valve which is of the same design and is not subject to tolerances.

The nominal effective injection time can be determined experimentally in advance by means of a typical injector output stage with a nominal behavior and by means of an injection valve which is of the same design and has a nominal behavior. The individual effective injection time can, as described above, be determined on the basis of the determined closing time for the electric actuation.

Figuratively speaking, in the described method the information "injector closing time" is used to detect the deviation of the actually injected fuel quantity from the nominal fuel quantity to be injected, which is defined by means of the setpoint value MFF_SP, and to adapt the electric actuation duration of the injection valve by means of a correction value in such a way that the deviation from the nominal fuel quantity is minimized. The accuracy of the injection quantity can be significantly improved via this method, in particular for injection quantities which are smaller than the minimum fuel quantity MFF_min.

According to one exemplary embodiment of the method, the time difference ($\Delta Ti_N$) between the nominal effective injection time and the individual effective injection time is weighted with a weighting factor (c).

According to one exemplary embodiment of the method, the valve is actuated on the basis of the acquired effective injection time ($Ti_N$).

In summary, a basic concept of an exemplary embodiment can be considered to be that, in a method for acquiring an effective injection duration or actuation duration of a valve, opening times and closing times which are actually determined or acquired are taken into account in order to permit improved fuel quantity injection, in particular in the case of short actuation times. In this context, the opening time is determined, for example, in a method for detecting the mechanical opening time of the valve needle of a fuel injection valve with a solenoid drive. As soon as the magnetic force which builds up between the lifting armature and the coil core during the energization of the solenoid overcomes the frictional forces and the valve needle which is coupled to the armature overcomes the hydraulic force of the fuel pressure, which hydraulic force acts in the closing direction, the lifting armature moves in the direction of the solenoid and therefore reduces the air gap between the lifting armature and the solenoid up to the time when an upper stop is reached. As a result of the change in the air gap in the magnetic circuit over time, a dynamic change occurs in the electric inductivity. The movement-induced change in inductivity brings about a characteristic current profile at the solenoid when the lifting armature impacts against the upper stop. This results in a feature in the profile of the actuation current which can be detected and on the basis of which the time of complete mechanical opening of the valve needle can be determined. This feature can be measured with high precision and is characteristic of the entire characteristic curve range of the injector. The detection of the feature can be improved by the actuation of the injector with a modified actuation profile. The knowledge of the mechanical opening time permits the injector opening time Topen to be determined, said injector opening time Topen being defined as the time difference between the switching on of the injector current (boost phase) and the detected complete opening of the valve needle.

In addition, the closing time can be acquired in a method for detecting the mechanical closing time of a valve needle. The detection of the closing time is based here principally on the same physical effect as that of the opening time. In the case of the coil-operated injection valve, a reduction in the magnetic force occurs after the switching off of the injector current. Owing to the spring pretension and hydraulic force there is a resulting force which accelerates the magnet armature and valve needle in the direction of the valve seat. The armature and valve needle reach their maximum speed directly before the impacting of the valve seat. The air gap between the coil core and the magnet armature increases with this speed. Owing to the movement of the magnet armature and the associated increase in the air gap, the remanent magnetism of the magnet armature brings about voltage induction in the injector coil. The maximum movement induction voltage which occurs characterizes the maximum speed of the magnet needle and therefore the time of mechanical closing of the valve needle.

The knowledge of the mechanical closing time permits the determination of the injector closing time Tclose, said injector closing time Tclose being defined as the time difference between the switching off of the injector current and the detected closing of the valve needle.

It is to be noted that to carry out the described method it is not necessary to determine the entire dynamics of the opening process or the closing process of the valve. For optimization of the valve actuation it is sufficient to determine merely the opening time or closing time. As a result the requirements made of the computing power of an engine control device are advantageously reduced.

It is also to be noted that the described injection time differs from a known injection time for the actuation of an injection valve over time in that previously obtained knowledge about the actual opening time or closing time of the valve is taken into account in the described injection time.

It is to be noted that embodiments of the invention have been described with reference to different subjects of the invention. In particular, a number of embodiments of the invention are described with method claims, and other embodiments of the invention are described with device claims. However, to a person skilled in the art reading this application it will immediately become clear that, unless explicitly stated otherwise, in addition to a combination of features which belong to one type of inventive subject matter, any other desired combination of features which belong to different types of inventive subjects is also possible.

Figure 3:
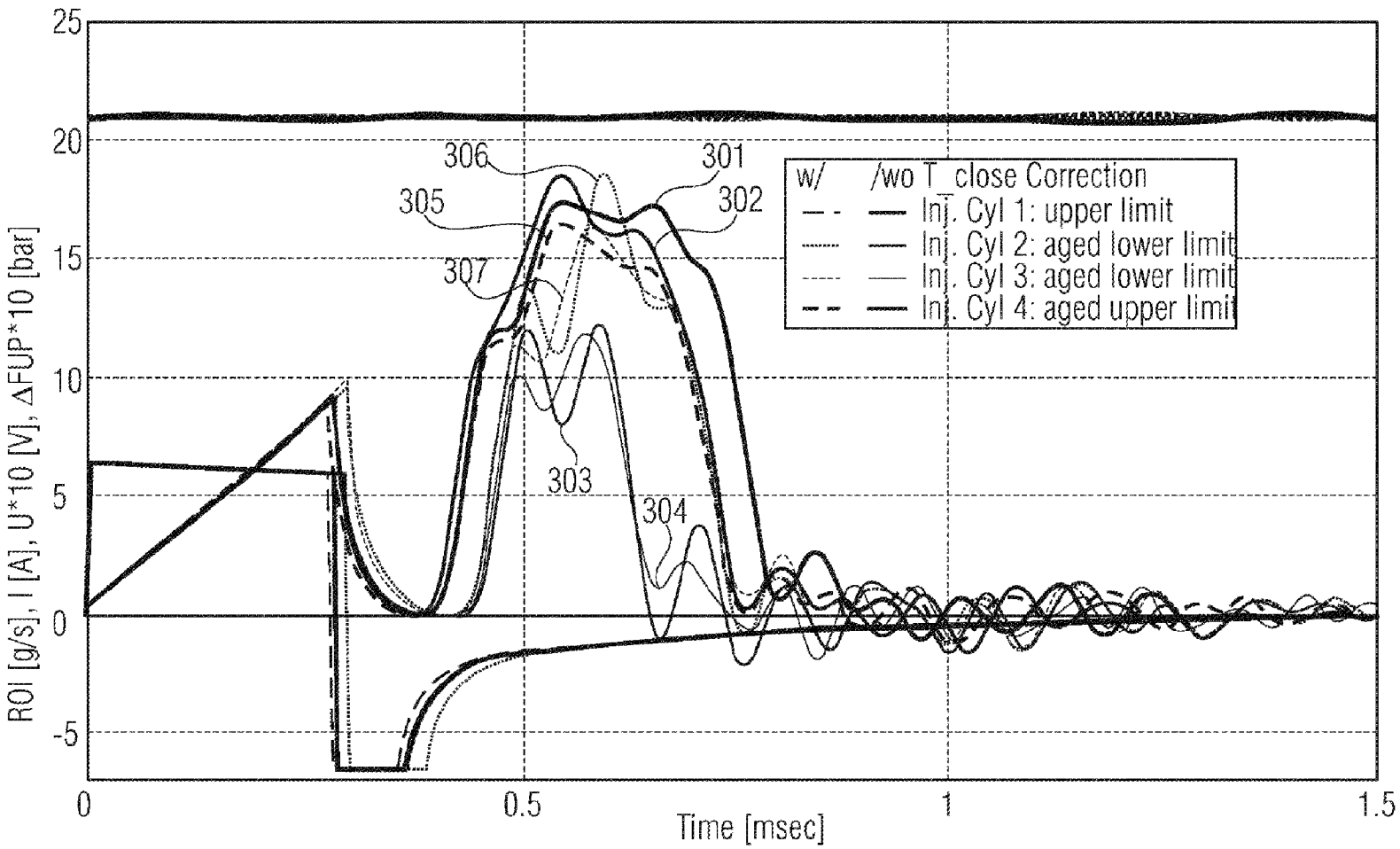
FIG. 3 shows the effects of variations in the opening time and the closing time.

FIG. 3 shows the effects of variations in the opening time and the closing time. In particular, FIG. 3 shows the effect of the variations occurring in the injector closing time (Tclose) and the injector opening time (Topen). From the injection rate profiles (ROI) 301, 302, 303 and 304 without Ti correction, represented by the continuous lines, it is apparent that the rate profiles vary highly from injector to injector during the closing as well as the opening. In this context, all the injection valves are actuated with an identical current profile. In addition, FIG. 3 also illustrates the injection quantity profiles 305, 306 and 307 for corrected injection times and actuation times, which have been corrected on an injector-specific basis taking into account the injector closing behavior. In this context it is to be noted that since an injector has been used as a reference for correction and therefore no longer exhibits any deviation owing to the method, only three corrected profiles are shown. In particular, it is apparent from FIG. 3 that the dotted current profiles and voltage profiles give rise to significantly improved approximation and reduction of the variations. The injection rate profiles (ROI) are essentially equalized during the closing of the injectors.

However, the existing variation in the injection rate profile becomes apparent after opening of the injectors. Since the injected fuel quantity is obtained from the integration of the injection rate profile over time, there is subsequently a considerable deviation of the actually injected fuel quantity from the fuel quantity setpoint value (MFF_SP).

Figure 4:
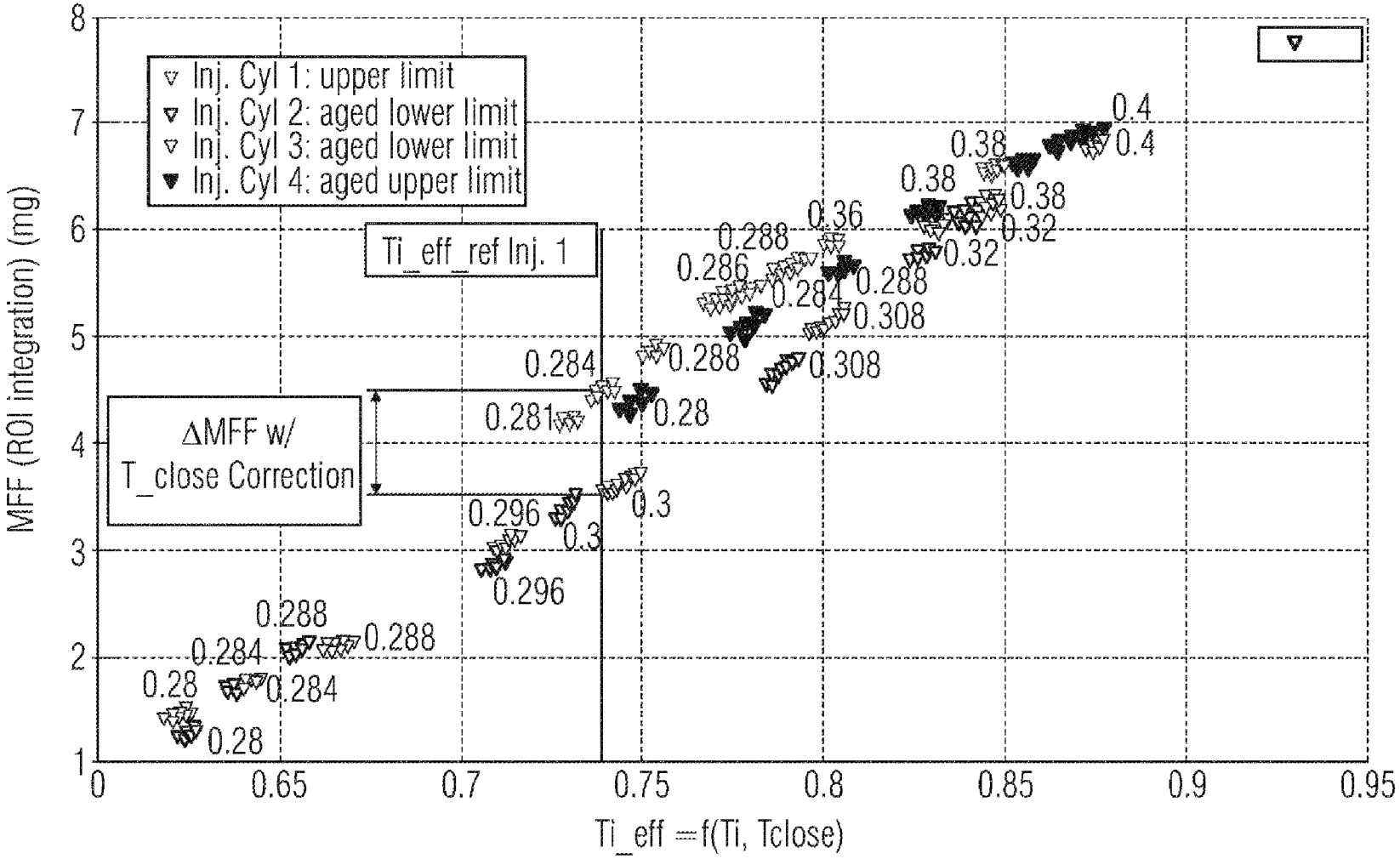
FIG. 4 shows the variations in the integrated fuel injection quantity for the four valves in FIG. 3 after correction for variations in the closing time.

FIG. 4 shows the variations in the integrated fuel injection quantity for the four valves in FIG. 3 after correction for variations in the closing time. FIG. 4 shows the integrated injector-specific and pulse-specific injection quantities (in mg) plotted against effective injection time or actuation time Ti_eff (in ms), wherein Ti_eff is a function of Ti and Tclose. In particular, FIG. 4 shows the result of the equalization of the injection quantities which can be achieved by the first step if the variations are corrected by different closing behavior. It is apparent that even after correction of the injection time taking into account the injector closing behavior, a reduction in the variations is achieved but a significant deviation of the injector-specific injection quantities remains. In particular, FIG. 4 shows the spread of the various injection quantities of the various valves, which spread is denoted by the double arrow 410.

A method according to an exemplary embodiment will be described below more precisely. The method is based on the idea that the following relationship for the nominal injector opening time Topen_nom can be determined for a nominal injector. This relationship can be stored, for example, by means of characteristic diagrams in the memory of an engine controller.

$$Topen_nom=f(MFF_SP,FUP,P_{cyl},\Theta_{fuel}), \quad (1)$$

where MFF_SP is the setpoint fuel mass or fuel quantity setpoint value, FUP is the fuel pressure, $P_{cyl}$ is the pressure in a cylinder and $\Theta_{fuel}$ is the temperature of the injected fuel.

By including the variables Topen and Tclose determined with the described methods the following transformation of the electric actuation time or actuation duration Ti is carried out:

$$Ti_eff=Ti+(Topen-Topen_nom)+Tclose, \quad (2)$$

where Topen is the opening time, Topen_nom is the nominal opening time determined above, Tclose is the closing time and Ti_eff is the effective actuation time.

As already described above, the opening time Topen is defined as the time difference between the switching on of the actuation current up to the maximum deflection of the injector needle or opening of the valve. The closing time Tclose is defined as the time difference between the switching off of the actuation current and the detected closing of the valve.

For example, the electric actuation duration Ti is stored in the engine controller as a characteristic diagram or as a set of characteristic diagrams. The cylinder internal pressure and the fuel temperature which are present during the injection are used as additional influencing variables.

$$Ti=f1(MFF_SP,FUP,P_{cyl},\Theta_{fuel}) \quad (3)$$

In addition, a characteristic diagram for the setpoint of the effective injection time Ti_eff_sup will also now be introduced. This relationship is determined experimentally on the basis of an injector output stage and an injector with nominal behavior.

$$Ti_eff_sp=f2(MFF_SP,FUP,P_{cyl},\Theta_{fuel}) \quad (4)$$

In the text which follows, an optimized setpoint value determination is described for the electric actuation of an injection valve for improving the quantity accuracy. The determined guide variable Ti_eff_sp is used for regulated operation of the injection valve for improving the quantity accuracy.

By means of equation (4), the associated effective injection duration Ti_eff_sp is determined for the nominal injection quantity MFF. A deviation of the actual injection quantity from the nominal quantity MFF_SP can be detected by means of a deviation of Ti_eff from the nominal value Ti_eff_sp.

Figure 5:
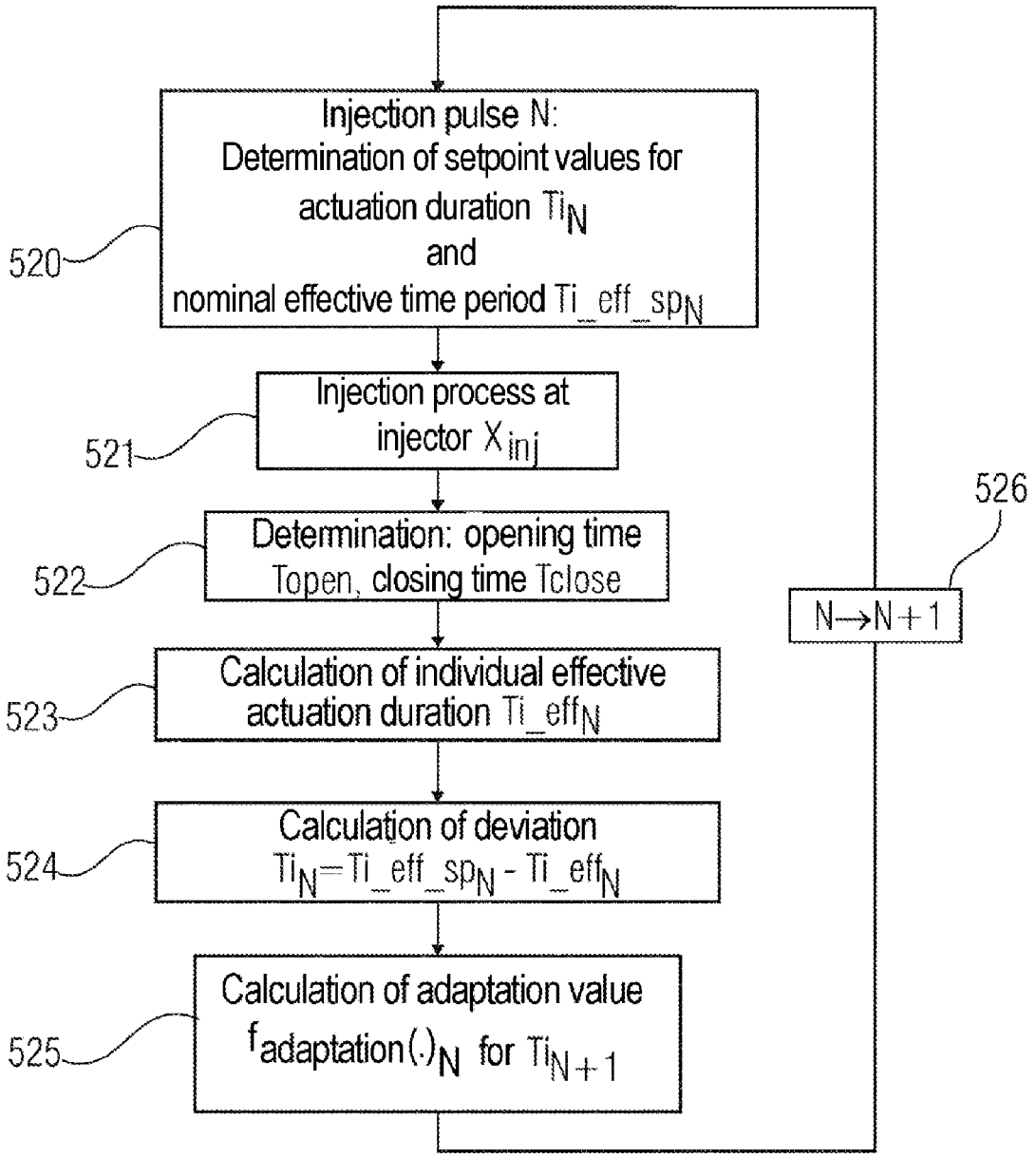
FIG. 5 is a schematic view of an algorithm for determining an actuation time.

The following algorithm, illustrated schematically in FIG. 5, is obtained for the regulated operation, said algorithm being carried out individually for each injector $N_{Inj}$. It is considered here starting at the N-th injection pulse:

Step 520:

In the step 520, setpoint values or setpoints for (A) the actuation duration $Ti_N$ and (B) the nominal effective injection time $Ti_eff_sp_N$ are acquired.

(A) The actuation duration $Ti_N$ for the N-th injection pulse is obtained here from the following equation (5):

$$Ti_N=f_1(\cdot)+f_{adaptation}(\cdot)_{N-1} \quad (5)$$

Here, the following applies $f_1(\cdot)=f_1(MFF_SP, FUP, P_{cyl}, \Theta_{fuel})$ (cf. abovementioned equation (3))

and $f_{adaptation}(\cdot)_{N-1}=f_{adaptation}(MFF_SP, FUP, P_{cyl}, \Theta_{fuel}, X_{inj})_{N-1}$ The adaptation characteristic diagram $f_{adaptation}$ is adapted online in the engine controller according to the exemplary embodiment illustrated here. The adaptation occurs individually for each injector. In the case of a new injection system (N=1) in which no values are yet stored in the non-volatile memory of the engine controller, the injection time is not corrected since no corrections have been learnt yet. This means that $f_{adaptation}$ has the value zero.

(B) The setpoint value for the nominal effective injection time $Ti_eff_sp_N$ for the N-th injection pulse is obtained from the abovementioned equation (4):

$$Ti_eff_sp_N=f_2(MFF_SP,FUP,P_{cyl},\Theta_{fuel})_N \quad (6)$$

Step 521:

In the step 521, the N-th injection process is carried out at injector $X_{inj}$ on the basis of the determined values for $Ti_N$ and $Ti_eff_sp_N$.

Step 522:

In the step 522, the opening time Topen, the nominal opening time Topen_nom and the closing time $Tclose_N$ are determined or measured with the method explained above.

Step 523:

In the step 523, the individual effective actuation duration $Ti_eff_N$ for the N-th injection process which is carried out is calculated for the respective injector. This is carried out in accordance with the abovementioned equation (2):

$$Ti_eff=Ti+(Topen-Topen_nom)+Tclose, \quad (7)$$

where Topen is the opening time, Topen nom is the nominal opening time determined above, Tclose is the closing time and Ti_eff is the effective actuation time.

Step 524:

In the step 524, the deviation $\Delta Ti_N$ is calculated. The following applies here:

$$\Delta Ti_N=Ti_eff_sp_N-Ti_eff_N \quad (8)$$

Step 525:

In the step 525, a new adaptation value $f_{adaptation}(\cdot)_N$ is calculated for a subsequent injection process. The new adaptation value $f_{adaptation}(\cdot)_N$ is obtained in a recursive fashion from the following equation (9):

$$f_{adaptation}(\cdot)_N=C\cdot\Delta Ti_N+f_{adaptation}(\cdot)_{N-1} \quad (9)$$

The following applies here:

$f_{adaptation}(\cdot)_N=f_{adaptation}(MFF_SP, FUP, P_{cyl}, \Theta_{fuel}, X_{inj})_N$ and $f_{adaptation}(\cdot)_{N-1}=f_{adaptation}(MFF_SP, FUP, P_{cyl}, \Theta_{fuel}, X_{inj})_{N-1}$ This means that the adaptation value $f_{adaptation}$ is learnt as a function of the operating conditions.

The weighting factor c can depend on the respective operating conditions by means of a characteristic diagram. The dependence of c is preferably acquired offline on the basis of experimental investigations. This means that the following applies:

$$c=f3(MFF_SP,FUP,P_{cyl},\Theta_{fuel}) \quad (10)$$

It is noted that direct time-discrete control cannot be carried out since the acquired control deviation $\Delta Ti_N$ is valid only for the operating conditions which occur during this injection pulse. For this reason, adaptation is necessary as a function of the operating conditions.

Step 526:

In step 526, the index N for the new current index N+1 is changed. The method is carried on with the step 520 described above.

In order to be able to implement any injection pulse with a very high quantity accuracy from the beginning at any start of the engine, for each injector the adaptation characteristic diagram $f_{adaptation}(MFF_SP, FUP, P_{cyl}, \Theta_{fuel}, X_{inj})$ can be stored on an injector-specific basis in the non-volatile memory of the engine controller during the running on of the engine controller.

It is to be noted that for operation with multiple injection it is necessary for the adaptation $f_{adaptation}$ to be carried out not only individually for each injector but also individually for each injection pulse.

Figure 6:
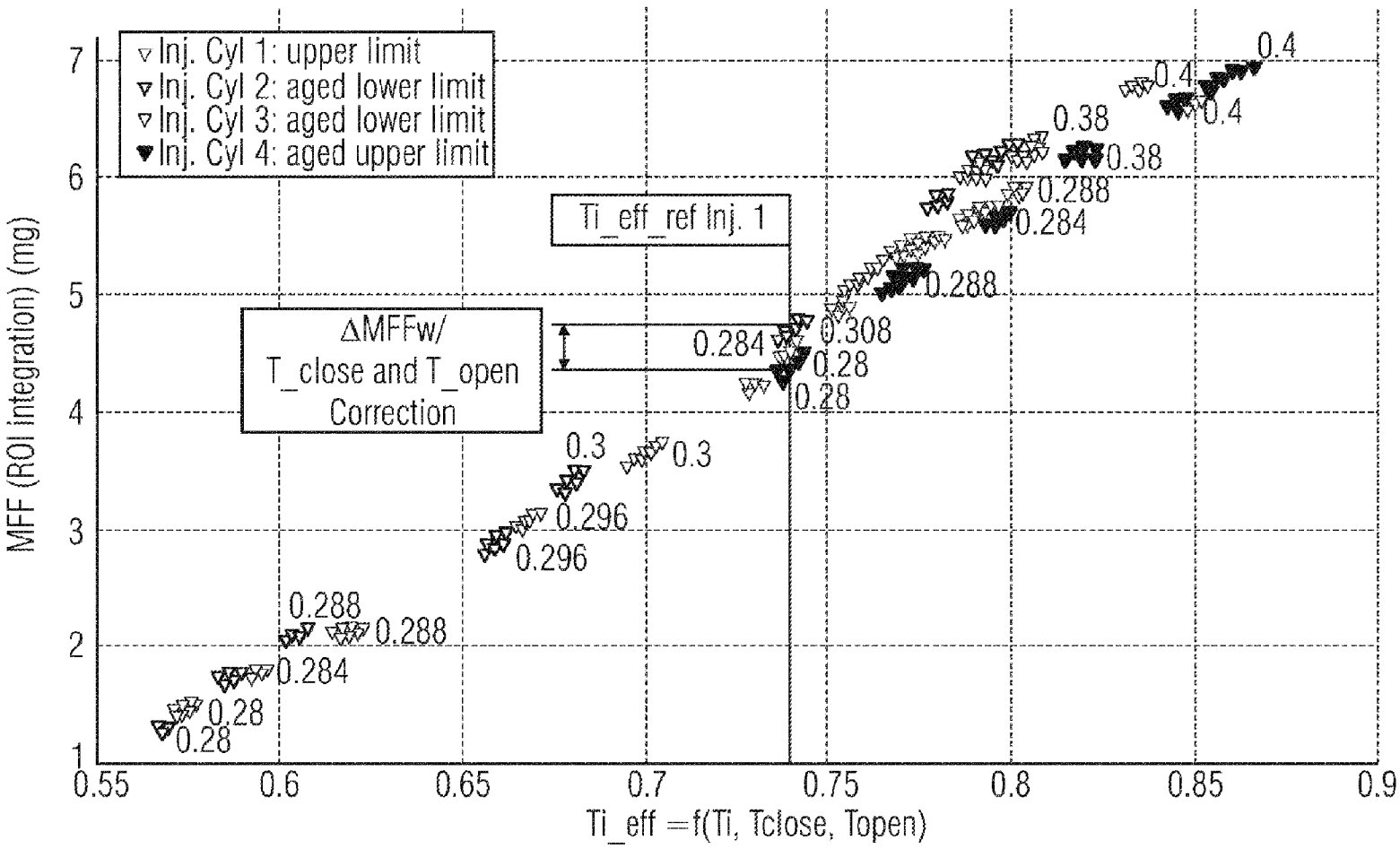
FIG. 6 shows variations in the integrated fuel injection quantity for the four valves in FIG. 3 after correction for variations in the closing time and opening time.

FIG. 6 shows a diagram in which variations in the integrated fuel injection quantity are represented for the four valves in FIG. 3 after correction for variations in the closing time and opening time. As in FIG. 4, FIG. 6 shows the integrated injection quantities (in mg) plotted against the effective injection time or actuation time Ti_eff (in ms), wherein here, in contrast to FIG. 4, Ti_eff is, however, a function of Ti, Topen, Topen-nom and Tclose. It is apparent from FIG. 6 that also taking into account the opening behavior of the injector brings about a reduction in the variations or spreads of the injection quantities for the individual injectors or valves. In order to clarify this effect, as in FIG. 4, a double arrow 630 which represents the variation is shown. FIG. 6 therefore shows the improvement in the injector-specific quantity accuracy by taking into account, as described, T_open in the correction of the electric injector actuation duration.

In addition it is to be noted that "comprising" or "having" do not exclude other elements or steps and "a" or "an" do not exclude a plurality. In addition it is to be noted that features or steps which have been described with reference to one of the above embodiments can also be used in combination with other features or steps of other embodiments described above.

LIST OF REFERENCE NUMBERS

301 Uncorrected profile of valve 1
302 Uncorrected profile of valve 2
303 Uncorrected profile of valve 3
304 Uncorrected profile of valve 4
305 Corrected profile of valve 2
306 Corrected profile of valve 3
307 Corrected profile of valve 4
410 Variation in injection quantity
520 First step
521 Second step
522 Third step
523 Fourth step
524 Fifth step
525 Sixth step
526 Seventh step
630 Variation in injection quantity

What is claimed is:

1. A method for operating a valve having a coil drive, the method comprising:

determining an opening time of the valve wherein the opening time measures a first duration from a first movement of the valve in an opening direction to an end of movement of the valve in an opening direction;

determining a closing time of the valve wherein the closing time measures a second duration from the end of movement of the valve in an opening direction to a fully closed position of the valve;

acquiring the effective injection time of the electric actuation of the valve for an injection process based at least on the determined opening time and the determined closing time, wherein the injection time is acquired by performing an iterative procedure for a sequence of different injection pulses, in which a correction value for the injection time of the electric actuation of the valve is determined for a future injection process as a function of:

(a) a correction value for the injection time of the electric actuation of the valve for a preceding injection process, and (b) a time difference between (b1) a nominal effective injection time for the electric actuation of the valve, and (b2) an individual effective injection time for the electric actuation of the valve for the preceding injection process, wherein the individual effective injection time is obtained from the time difference between the start of the electric actuation of the valve for the preceding injection process and the determined closing time for the preceding injection process; and actuating the valve for a desired injection time based on the determined correction value.

2. The method of claim 1, wherein the effective injection time is acquired using the formula $$Ti_eff=Ti+(Topen-Topen_nom)+Tclose,$$

where Topen is the determined opening time, Tclose is the determined closing time, Topen_nom is a nominal opening time for a valve and Ti is a calculated nominal injection time.

3. The method of claim 1, wherein the determination of the opening time comprises:

determining a current profile at a solenoid of a solenoid valve, and determining the opening time based at least on the determined current profile.

4. The method of claim 1, wherein the determination of the closing time comprises:

switching off a current flow through a coil of the coil drive, such that the coil is currentless, detecting a time profile of a voltage induced in the currentless coil, and determining the closing time of the valve based on the detected time profile.

5. The method of claim 4, wherein the determination of the closing time comprises comparing (a) a time derivative of the detected time profile of the voltage induced in the coil with (b) a time derivative of the reference voltage profile.

6. The method of claim 1, comprising weighting the time difference between the nominal effective injection time and the individual effective injection time with a weighting factor.

7. An engine controller configured to acquire an effective injection time of a valve having a coil drive, the device comprising:

a unit configured to determine an opening time of the valve;

a unit configured to determine a closing time of the valve;

wherein the opening time measures a first duration from a first movement of the valve in an opening direction to an end of movement of the valve in an opening direction;

wherein the closing time measures a second duration from the end of movement of the valve in an opening direction to a fully closed position of the valve;

a unit configured to acquire the effective injection time of the electric actuation of the valve for an injection process based on the determined opening time and the determined closing time, wherein the injection time is acquired by performing an iterative procedure for a sequence of different injection pulses, in which a correction value for the injection time of the electric actuation of the valve is determined for a future injection process as a function of:

(a) a correction value for the injection time of the electric actuation of the valve for a preceding injection process, and (b) a time difference between (b1) a nominal effective injection time for the electric actuation of the valve, and (b2) an individual effective injection time for the electric actuation of the valve for the preceding injection process, wherein the individual effective injection time is obtained from the time difference between the start of the electric actuation of the valve for the preceding injection process and the determined closing time for the preceding injection process; and wherein the controller actuates the valve for a desired injection time based on the determined correction value.

8. The engine controller of claim 7, wherein the effective injection time is acquired using the formula $$Ti_eff=Ti+(Topen-Topen_nom)+Tclose,$$

where Topen is the determined opening time, Tclose is the determined closing time, Topen_nom is a nominal opening time for a valve and Ti is a calculated nominal injection time.

9. The engine controller of claim 7, wherein the determination of the opening time comprises:

determining a current profile at a solenoid of a solenoid valve, and determining the opening time based at least on the determined current profile.

10. The engine controller of claim 7, wherein the determination of the closing time comprises:

switching off a current flow through a coil of the coil drive, such that the coil is currentless, detecting a time profile of a voltage induced in the currentless coil, and determining the closing time of the valve based on the detected time profile.

11. The engine controller of claim 10, wherein the determination of the closing time comprises comparing (a) a time derivative of the detected time profile of the voltage induced in the coil with (b) a time derivative of the reference voltage profile.

12. The engine controller of claim 7, wherein the time difference between the nominal effective injection time and the individual effective injection time is weighted with a weighting factor.

* * * * *